United States Patent [19]

Miyatake et al.

[11] 4,222,226

[45] Sep. 16, 1980

[54] MULTI-RANGE TIMER

[75] Inventors: Osamu Miyatake; Hirotake Murakami; Masakatsu Hishinuma, all of Kanagawa, Japan

[73] Assignee: Fuji Electric Co., Ltd., Kawasaki, Japan

[21] Appl. No.: 11,828

[22] Filed: Feb. 13, 1979

[30] Foreign Application Priority Data

Feb. 14, 1978 [JP] Japan ..... 53/15669
Feb. 14, 1978 [JP] Japan ..... 53/15670

[51] Int. Cl.[3] ..... G04F 5/06; G04F 5/10

[52] U.S. Cl. ..... 368/113; 235/92 T; 368/118

[58] Field of Search ..... 58/39.5, 23 AC, 22.9; 235/92 T; 324/186; 331/108 B, 74; 328/48; 307/226 R

[56] References Cited

U.S. PATENT DOCUMENTS 2,844,790 7/1958 Thompson et al. ..... 324/186
3,045,191 7/1962 Blanchard ..... 331/108 B
3,713,285 1/1973 Haufe ..... 58/39.5

*Primary Examiner*—J. V. Truhe
*Attorney, Agent, or Firm*—Sughrue, Rothwell, Mion, Zinn and Macpeak

[57] ABSTRACT

A multi-range timer comprising an RC oscillator with a variable resistor whose resistance is varied with rotation of a dial. A fixed frequency divider circuit frequency-divides the output of the RC oscillator. A variable frequency divider circuit receives an output of the fixed frequency divider circuit, and a time setting section having a digital switch switches a frequency division ratio of the variable frequency divider circuit. The time limit is changed by switching the digital switch. The time setting section comprises a dial and a plurality of numerical value scales distinguished from one another by color, each of said scales having the same color as the display surface of said digital switch, which indicates a selected time setting range.

14 Claims, 5 Drawing Figures

MULTI-RANGE TIMER

BACKGROUND OF THE INVENTION

This invention relates to a multi-range timer with which time can be set over a wide range.

In general, timers should be able to set and measure time over a wide time range from a short time period to a long time period according to their intended use. In the case where it is required to provide time limits of, for instance, one second, 5 seconds, 10 seconds, 30 seconds, 60 seconds, 5 minutes, 10 minutes, 30 minutes, 60 minutes and 5 hours, it is necessary to provide ten different timers according to these time limits. In this case, the use of a number of different timers is undoubtedly troubleson. Also, in view of varying demands, it is practically impossible to manufacture enough different timers to meet all demands of users.

In order to eliminate the above described difficulties, timers with a plurality of time limits have been proposed and manufactured. One of the conventional timers of this type is a motor timer, in which by changing the output speed of the motor with a reduction gear mechanism, the time limit can be changed by changing the gear ratio of the mechanism. In this timer, a plurality of time limits can be set by using only a single timer. However, the timer is still disadvantageous in that the gear ratio changing mechanism is rather intricate which results in a high manufacturing cost.

SUMMARY OF THE INVENTION

Accordingly, it is a primary object of this invention to provide a timer in which all of the above described difficulties accompanying a conventional timer have been eliminated.

Another object of this invention is to provide a timer which has a number of time limits which can be readily set up, and is low in manufacturing cost.

A further object of this invention is to provide a timer in which it is readily possible to select a numerical value scale to be used when a time setting range is changed by the switching operation of a digital switch.

The foregoing objects of this invention are achieved by the provision of a multi-range timer comprising an RC oscillator with a variable resistor whose resistance is varied with rotation of a dial. A fixed frequency divider circuit frequency-divides the output of the RC oscillator and a variable frequency divider circuit frequency-divides the output of the fixed frequency divider circuit. A time setting section having a digital switch switches the frequency division ratio of the variable frequency divider circuit, whereby the time limit is changed by switching the digital switch. The time setting section is provided with numerical value scales which have the same color as the display surface of the corresponding digital switch. Furthermore, detachable numerical value scales may be employed to make it more easy to read out the graduations of scale.

This invention will be described with reference to its preferred embodiments shown in the accompanying drawings.

BRIEF DESCRIPTION OF THE DRAWINGS

FIG. 4(*b*) is also an enlarged view of a numerical value scale plate of the second embodiment of this invention.

DESCRIPTION OF THE PREFERRED EMBODIMENTS

Figure 1:
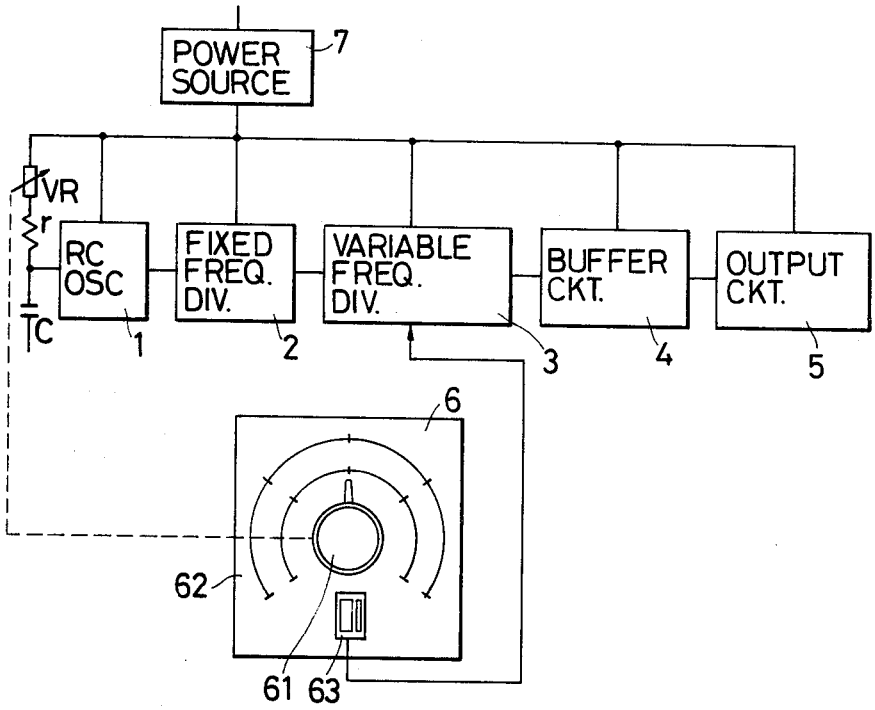
FIG. 1 is a block diagram showing one embodiment of the invention.

A first embodiment of the invention is shown in FIG. 1 which is a block diagram showing the essential parts thereof. In FIG. 1, reference numeral 1 designates an RC oscillator whose oscillation frequency is determined from the values of a variable resistor VR, a resistor r and a capacitor C. Reference numeral 2 is a fixed frequency divider circuit for forming a time pulse signal corresponding to the minimum scale of time setting in the timer by subjecting the output of the RC oscillator 1 to frequency division. A variable frequency divider circuit 3 forms time setting pulse signals corresponding to various settings of time used in a wide range from short to long time periods in the timer by frequency-dividing the pulse signal provided by the fixed frequency divider circuit 2;

A buffer circuit 4 holds the output of the variable frequency divider circuit 3 and driving an output circuit 5. A time setting section 6 is formed with a dial 61, a scale board 62 and a digital switch 63. Also shown in FIG. 1 is an electric source circuit 7.

The dial 61 of the time setting section 6 is operatively connected as shown by the broken line to the variable resistor VR in the oscillator 1, so that as the dial 61 is turned from the lower scale value toward the higher scale value on the scale plate 62, the resistance of the variable resistor VR is changed to decrease the oscillation frequency. The digital switch 63 of the time setting section 6 is coupled to the variable frequency divider circuit 3 so that the frequency division ratio of the frequency divider circuit 3 is determined according to the output of the digital switch 63. The digital switch 63 has a display surface on which the scale on the scale board 62 is displayed.

Figure 2:
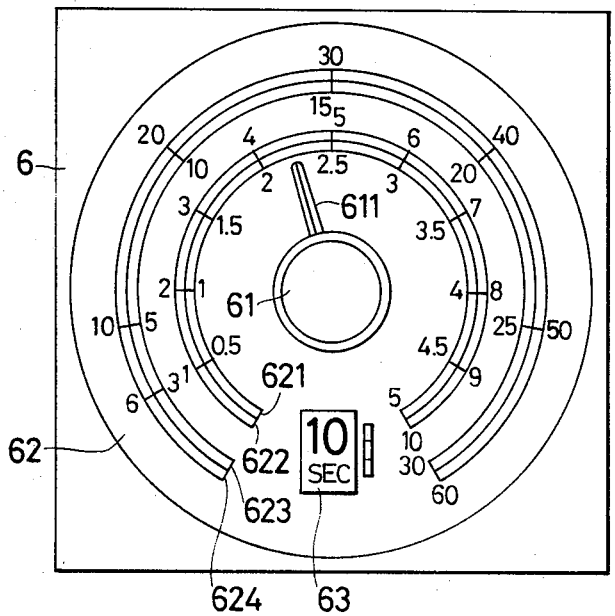
FIG. 2 is an enlarged view showing a time setting section.

Shown in FIG. 2 is the display section with the graduations of a timer which has a time setting range from 0.1 second to 5 hours which is divided into ten multiranges as indicated in Table 1 below.

FIG. 2 is an enlarged diagram showing the time setting section 6. Provided on the scale board 62 are numerical value scales 621, 622, 623 and 624 which cover a numerical value "0.5" to a numerical value "5", "1"–"10", "3"–"30", and "6"–"60", respectively. The numerical value scale 621 serves for the ranges 2, 6 and 10 of the multiranges; the numerical value scale 622, for the 1, 3 and 7; numerical value scale 623, for the ranges 4 and 8; and the numerical value scale 624, for the ranges 5 and 9. The scales 621 through 624 may be distinguished from one another by color. More specifically, the scales 621, 622, 623 and 624 may be colored red, blue, yellow and black, respectively.

The display surface of the digital switch 63 appears in the scale board 62 of the time setting section 6. The digital switch 63 is switched every 1/10 revolution thereof, to show different data provided on the display surface. More specifically, the display surface of the digital switch 63 has different colors and characters according to the ranges 1 through 10 as shown in Table 1 below:

TABLE 1

| Range | Time Setting Range | Digital switch Character | Digital switch Color | BCD Output Code of Digital Switch |
|---|---|---|---|---|
| 1 | 0.1–1 seconds | 1 sec. | Blue | 0000 |
| 2 | 0.5–5 seconds | 5 sec. | Red | 1000 |
| 3 | 1–10 seconds | 10 sec. | Blue | 0100 |
| 4 | 3–30 seconds | 30 sec. | Yellow | 1100 |
| 5 | 6–60 seconds | 60 sec. | Black | 0010 |
| 6 | 0.5–5 minutes | 5 min. | Red | 1010 |
| 7 | 1–10 minutes | 10 min. | Blue | 0110 |
| 8 | 3–30 minutes | 30 min. | Yellow | 1110 |
| 9 | 6–60 minutes | 60 min. | Black | 0001 |
| 10 | 0.5–5 hours | 5 Hr. | Red | 1001 |

The numerical value scales 621 through 624 and the display surface shown in FIG. 2 are differently colored as described above. Therefore, in the case where, for instance, the timer is used in the time setting range "1–10 seconds", the digital switch 63 is switched to allow the character "10 sec" indicating the maximum graduation value 10 seconds to appear in the scale board 62. In this case, it can be readily determined at a glance that among the numerical value scales the numerical value scales 622 colored blue should be selected in use because the color of the display surface of the digital switch 63 is blue.

Generally stated, the timer is set to a desired time setting value as follows: The digital switch 63 is operated so that the character on the display surface of the digital switch 63 shows the maximum graduation value of a time setting range which covers the desired time setting value. The dial 61 is set to the desired time setting value on the numerical value scale which has the same color as the display surface of the digital switch 63 which has appeared in the scale board by the operation of the digital switch 63. Upon operation (switching) of the digital switch 63, the time setting ranges is changed by the variable frequency divider circuit 3. This will now be described with reference to FIG. 3 in detail.

Figure 3:
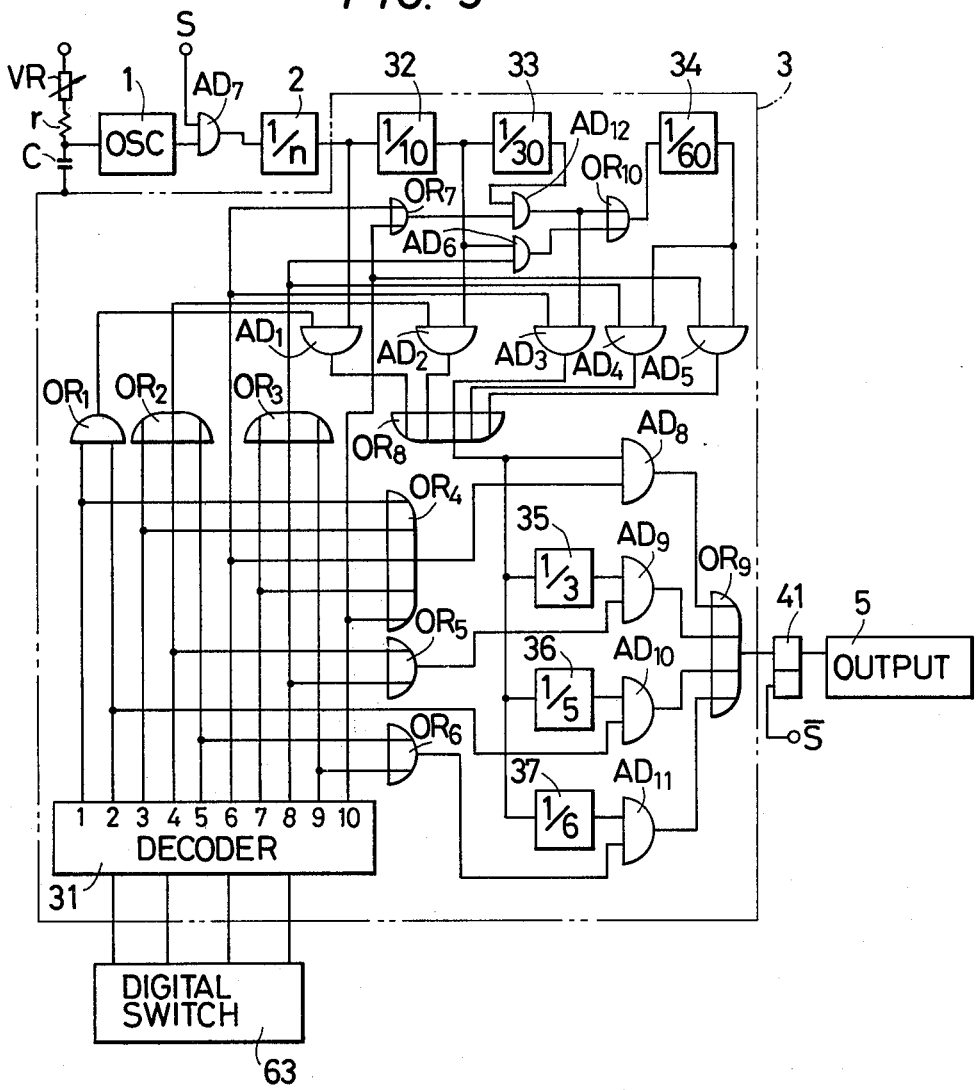
FIG. 3 is a circuit diagram showing a variable frequency divider circuit.

The circuitry shown in FIG. 3 comprises the RC oscillator 1, the fixed frequency divider circuit 2, the output circuit 5, and the digital switch 63 which have been referred to already. It is noted that these elements are well known to those skilled in this art and need not be described in greater detail. A variety of equivalent elements can be used to perform the functions of these components. The circuitry shown in FIG. 3 further comprises: a flip-flop 41 forming the buffer circuit 4; a decoder 31; and the variable frequency divider circuit with frequency dividers 32 through 37; OR circuits OR1 through OR10; and AND circuits AD1 through AD12 forming the variable frequency divider circuit.

The variable resistor VR in the RC oscillator is set by the operation of the dial 61 so that when the pointer 611 of the dial 61 is set to the maximum graduation value; that is, the position "5", "10", "30" and "60" of the numerical value scales 621 through 624, the fixed frequency divider circuit 2 outputs one pulse per second. When the pointer 611 of the dial 61 is set to the position "0.5", "1", "3", and "6" of the numerical value scales 621 through 624, the fixed frequency divider circuit 2 outputs one pulse per 0.1 second. Hence, in this example, the RC oscillator is set so that the fixed frequency divider circuit 2 provides one pulse at time intervals of 0.1 to 1 second. Accordingly, if the pointer 611 of the dial 61 is set to the graduation "1" on the numerical value scale 622, the pulse is provided every 0.1 second by the frequency divider circuit 2. If the pointer 611 is set to the graduation "2" on the numerical value scale 622, the pulse is provided every 0.2 second. Thus, if the pointer 611 is set to the graduations "3", "4", "5", "6","7", "8", "9" and "10", then the pulse is outputted by the fixed frequency divider circuit 2 every 0.3, 0.4, 0.5, 0.6, 0.7, 0.8, 0.9 and 1 seconds, respectively.

The frequency divider 32 operates to subject the output of the fixed frequency divider circuit 2 to 1/10 frequency division. The frequency divider 33 operates to subject the output of its preceding stage to 1/30 frequency division. The frequency divider 34 operates to subject the output of its preceding stage to 1/60 frequency division. The frequency dividers 35, 36 and 37 subject the outputs of relevant OR circuits to 1/3, 1/5 and 1/6 frequency division, respectively.

The operation of the circuitry shown in FIG. 3 will now be described. The BCD outputs of the digital switch 63 are as indicated in Table 1 hereinabove. In the situation where the display surface of the digital switch 63 shows "1 sec" and blue, only the "1" output of the decoder 31 has a logical signal level "1" (hereinafter referred to merely as "1" when applicable) and the remaining outputs thereof have a logical signal level "0" (hereinafter referred to merely as "0" when applicable). The "1" output of the decoder 31 is applied through the OR circuit OR1 to the AND circuit AD1. If, under this condition, the pointer 611 is set to the graduation "10" on the numerical value scale 622 colored blue, then a time operation start signal S is applied to one input terminal of the AND circuit AD7, and the output of the RC oscillator 1 is applied through the AND circuit AD7 to the fixed frequency divider circuit 2.

Thus, a signal "1" is outputted by the fixed frequency divider circuit 2 one second after the application of the time operation start signal S. When this output is applied to the AND circuit AD1, the AND condition of the AND circuit AD1 is satisified, and therefore the latter is rendered conductive. When the output of the AND circuit AD1 is applied through the OR circuit OR8 to one input terminal of the AND circuit AD8, the latter AD8 is rendered conductive as the signal "1" from the "1" output of the decoder 31 has been applied to the other input terminal of the AND circuit AD8.

The output of the AND circuit AD8 is applied to the flip-flop 41 to set the latter. As a result the output circuit 5 is driven to provide a time output signal. The flip-flop 41 is reset by a signal $\overline{S}$ obtained by inverting the time operation start signal S.

If the application of the time operation start signal S is effected after the pointer 611 of the dial 61 is set to the graduation "1" on the numerical value scale 622 with the digital switch 63 remaining unswitched, then similarly as in the above-described case the output of the RC oscillator 1 is applied through the AND circuit AD7 to the fixed frequency divider circuit 2. The signal "1" is outputted by the fixed frequency divider circuit 2 in only 0.1 second after the application of the time operation start signal S. This output signal "1" is applied through the AND circuit AD1, the OR circuit OR8, the AND circuit AD8 and the OR circuit OR8 to the flip-flop 41. As a result, the output circuit 5 provides the time output signal.

In the case where the digital switch 63 is operated to allow the display surface to show "5 sec" and for example a red color, the "2" output of the decoder 31 has "1" and the remaining outputs thereof have "0". Therefore, the signal "1" is applied to one input terminal of the AND circuit AD1 through the OR circuit OR1 and to one input terminal of the AND circuit AD10. If, under this condition, the pointer 611 of the dial 61 is set to the graduation "5" on the numerical value scale 621 and then the time operation start signal S is applied, the fixed frequency divider circuit 2 outputs a signal "1" every one second after the application of the time operation start signal S.

This output pulse is applied through the AND circuit AD1 and the OR circuit OR8 to the AND circuit AD8 and the frequency dividers 35 to 37. A signal "1" is outputted by the frequency divider 36 five seconds after the application of the time operation start signal S. Accordingly, when the signal "1" is applied to the AND circuit AD10, the latter AD10 is rendered conductive.

The output of the AND circuit AD10 is applied through the OR circuit OR9 to the flip-flop 41, where it is stored. The output circuit 5 outputs the time output signal five seconds after the application of the time operation start signal S. In this connection, the fixed frequency divider circuit 2 also applies "1" to one input terminal of the AND circuit AD8 and to one input of AD9 through the frequency divider 35 one second and three seconds, respectively, after the application of the time operation start signal S. However, the AND circuits AD8 and AD9 are not rendered conductive because their other input terminals are not maintained at a logical level "1".

If the pointer 611 of the dial 61 is set to the graduation "0.5" on the numerical value scale 621 with the digital switch 63 remaining unswitched, then the fixed frequency divider circuit 2 outputs a signal "1" every 0.1 second, and the frequency divider 36 outputs "1" 0.5 second after the application of the time operation start signal S. Accordingly, the AND circuit AD10 is rendered conductive, and the time output signal is provided by the output circuit 5.

In the case where the digital switch 63 is switched to allow the display surface to show "10 sec" and for example a blue color, only the "3" output of the decoder is raised to the logical level "1", and this output signal "1" is applied through the OR circuit OR2 to one input terminal of the AND circuit AD2 and through the OR circuit OR4 to one input terminal of the AND circuit AD8. When the time operation start signal S is applied after the pointer 611 of the dial 61 has been set to the graduation "10" on the numerical value scale 622, the frequency divider 32 outputs "1" ten seconds after tha application of the time operation start signal S.

As a result, the AND circuit AD2 is rendered conductive, and the output "1" of the AND circuit AD2 is applied through an OR circuit OR8 to one input terminal of the AND circuit AD8 the other input terminal of which is connected to the "3" output of the decoder 31 and is at the logical level "1". Thus, the time output signal is provided, through the OR circuit OR9 and the flop-flop 41, in the output circuit 5.

If the pointer 611 of the dial 61 is set to the graduation "1" on the numerical value scale 622 with the digital switch 63 maintaining unswitched, the frequency divider outputs "1" one second after the application of the time operation start signal S. As in the above-described case, the time output signal is provided, through the logical circuits AD2, OR8, AD8 and OR9 and the flip-flop 41, in the output circuit 5.

In the case where the digital switch 63 is switched to permit the display surfce to show "30 sec" for example a yellow color, only the "4" output of the decoder 31 is raised to the level "1", and this output "1" is applied through an OR circuit OR2 to one input terminal of the AND circuit AD2 and through the OR circuit OR5 to one input terminal of the AND circuit AD9. If the pointer 611 of the dial 61 is set to the graduation "30" on the scale 623, the frequency divider 32 outputs a signal "1" every ten seconds after the application of the time operation start signal S. The signal "1" is applied through the AND circuit AD2 and the OR circuit OR8 to the frequency divider 35. Thus, the frequency divider 35 outputs the signal "1" thirty seconds after application of the start signal. As a result, the AND circuit AD9 is rendered conductive and the time output signal is provided, through the OR circuit OR9 and the flip-flop 41, in the output circuit 5. If the pointer 611 of the dial 61 is set to the graduation "3" on the scale 623 with the digital switch 63 maintaining unswitched, the frequency divider 32 outputs a signal "1" everyone second after the application of the time operation start signal S. Therefore, as in the above-described examples, the signal "1", applied through the AND circuit AD2 and the OR circuit OR8, is outputted by the frequency divider 35. Thus, the output "1" is applied through the OR circuit OR9 and the flip-flop 41 to the output circuit 5, in which the time output signal is provided.

In the case where the digital switch 63 is switched to allow the display surface to show "60 sec" and a black color, only the "5" output of the decoder 31 has "1" which is applied through the OR circuit OR2 to one input terminal of the AND circuit AD2 and through the OR circuit OR6 to one input terminal of the AND circuit AD11. If the pointer 611 of the dial 61 is set to the graduation "60" on the numerical value scale 624, the frequency divider 32 outputs "1" every ten seconds after the application of the time operation start signal S. Therefore, the signal "1", applied through the logical circuits AD2 and OR8, is outputted by the frequency divider 37 sixty seconds after the start signal.

Thus, the time output signal is provided, through the logical circuits AD11 and OR9, in the output circuit 5. If the pointer 611 of the dial 61 is set to the graduation "6" on the numerical value scale 624 with the digital switch 63 remaining unswitched, then the frequency divider 32 produces "1" every one second after the application of the time operation start signal S. As a result, the frequency divider 37 outputs "1" six seconds after, and the time output signal is therefore produced in the output circuit 5.

In the case where the digital switch 63 is operated to allow the display surface to show "5 min" and a red color, only the "6" output of the decoder 31 has a signal "1" which is applied directly to one input terminal of the AND circuit AD3, applied through the OR circuit OR7 to one input terminal of the AND circuit AD12, and applied through the OR circuit OR4 to one input terminal of the AND circuit AD8. If the pointer 611 of the dial 61 is set to the graduation "5" on the numerical value scale 621, a signal "1" is outputted by the frequency divider 33 five minutes after the application of the time operation start signal S. This signal "1" is applied to one input terminal of the AND circuit AD8 through the logical circuits AD12, AD3 and OR8. As a result, the time output signal is provided, through the OR circuit OR9 and the flip-flop 41, in the output circuit 5.

If the pointer 611 of the dial 61 is set to the graduation "0.5" on the numerical value scale 621 with the digital switch 63 maintaining unswitched, the frequency divider 33 outputs a signal "1" thirty seconds after the application of the time operation start signal S. Thus, similarly as in the above described case, the time output signal is provided, through the logical circuits AD12, AD3, OR8, AD8, and OR9, in the output circuit 5.

In the case where the digital switch 63 is operated to permit the display surface to show "10 min" and a blue color, only the "7" output of the decoder 31 has a signal "1". This output signal "1" is applied through the OR circuit OR3 to one input terminal of each of the AND circuits AD4 and AD6 and through the OR circuit OR4 to one input terminal of the AND circuit AD8. With the pointer 611 of the dial 61 set to the graduation "10" on the numerical value scale 622, the frequency divider 32 outputs "1" every ten seconds after the application of the time operation start signal S and the AND circuit AD6 is rendered conductive. The output signal of the AND circuit AD6 is applied through the OR circuit OR10 to the frequency divider 34, and then the frequency divider 34 outputs "1" every ten minutes after the application of the time operation start signal S. The output signal "1" is applied through the logical circuits AD4, OR8, AD8 and OR9 to the flip-flop 41. As a result, the time output signal is provided in the output circuit 5.

If the pointer 611 of the dial 61 is set to the graduation "1" on the numerical value scale 622 with the digital switch 63 maintaining unswitched, then the AND circuit AD6 is rendered conductive every one second after the application of the time operation start signal S to supply the output signal "1" through the OR circuit OR10 to the frequency divider 34. Therefore, the frequency divider 34 outputs "1" every one minute after the application of the time operation start signal S. Accordingly, the time output signal is provided in the output circuit 5 through the logical circuits AD4, OR8, AD8 and OR9 and the flip-flop 41.

In the case where the digital switch 63 is operated to permit the display surface to show "30 min" and a yellow color, only the "8" output of the decoder 31 has a signal "1". This output signal is applied through the OR circuit OR3 to the one input terminal of each of the AND circuits AD4 andAD6 and through the OR circuit OR5 to one input terminal of the AND circuit AD9. With the pointer 611 of the dial 61 set to the graduation "30" on the numerical value scale 623, the frequency divider 32 outputs "1" every ten seconds after the application of the time operation start signal S to thereby render the AND circuit AD6 conductive every ten seconds. The output signal "1" is applied through the OR circuit OR10 to the frequency divider 34. The frequency divider 34 outputs "1" every ten minutes after the application of the time operation start signal S. The output signal "1" is then applied through the logical circuits AD4 and OR8 to the frequency divider 35. The frequency divider 35 provides "1" thirty minutes after the application of the time operation start signal S. Thus, the time output signal is provided in the output circuit 5 through the logical circuits AD9 and OR9 and the flip-flop 41.

If the pointer 611 of the dial 61 is set to the graduation "3" on the numerical value scale 623 with the digital switch 63 maintaining unswitched, then the AND circuit AD6 is rendered conductive every one second after the application of the time operation start signal S. Therefore, the frequency divider 34 outputs "1" every one minute after the application of the time operation start signal S. Then, the frequency divider 35 provides "1" three minutes after the application of the time operation start signal S. Thus, the time output signal is provided in the output circuit 5 through the logical circuits AD9 and OR9 and the flip-flop 41.

When the digital switch 63 is operated so that the display surface shows "60 min" and a black color, only the "9" output of the decoder 31 has the signal "1". This signal is applied through the OR circuit OR3 to one input terminal of each of the AND circuits AD4 and AD6 and through the OR circuit OR6 to one input terminal of the AND circuit AD11. If the pointer 611 of the dial 61 is set to the graduation "60" of the numerical value scale 624, then the AND circuit AD6 is rendered conductive every ten seconds after the application of the time operation start signal. The output signal of the AND circuit AD6 is applied to the frequency divider 34 through the OR circuit OR10. Thus, the frequency divider 34 output "1" every ten minutes after the application of the time operation start signal S.

Whenever the "1" is outputted by the frequency divider 34, it is applied through the logical circuits AD4 and OR8 to the frequency divider 37. The frequency divider 37 provides "1" sixty minutes after the application of the time operation start signal S. Thus, the time output signal is provided in the output circuit through the logical circuits AD11 and OR9 and the flip-flop 41. If the pointer 611 of the dial 61 is set to the graduation "6" on the numerical value scale 624 without switching the digital switch 63, then the AND circuit AD6 is rendered conductive every one second after the application of the time operation start signal S. As a result, the frequency divider 37 provides "1" six minutes after the application of the time operation start signal S, and the time output signal is provided in the output circuit 5 through the logical circuits AD11 and OR9 and the flip-flop 41.

In the case where the digital switch 63 is switched so that the display surface shows "5 Hr" and a red color, only the "10" output of the decoder 31 has "1". This signal is applied to one input terminal of the AND circuit AD5, through the OR circuit OR7 to one input terminal of the AND circuit AD12, and through the OR circuit OR4 to one input terminal of the AND circuit AD8. If the pointer 611 of the dial 61 is set to the graduation "5" on the numerical value scale 621, the frequency divider 32 outputs "1" every ten seconds after the application of the time operation start signal S. The frequency divider 33 outputs "1" every five minutes after the application of the time operation start signal S.

Whenever the "1" is outputted by the frequency divider 33, the AND circuit AD12 is rendered conductive and the output of the AND circuit AD12 is applied to the frequency divider 34 through the OR circuit OR10. Thus, the frequency divider 34 outputs "1" five hours after the application of the time operation start signal S. As a result, the time output signal is provided in the output circuit 5 through the logical circuits AD5, OR8, AD8 and OR9 and the flip-flop 41.

If the pointer 611 of the dial 61 is set to the graduation "0.5" on the numerical value scale 621 with the digital switch 63 maintaining unswitched, then the frequency dividers 32 and 33 output signals "1" every one second and every thirty seconds after the application of the time operation start signal S, respectively. Thus, the output of the frequency divider 33 is applied to the frequency divider 34 through the logical circuits AD12 and OR10. The frequency divider 34 outputs "1" thirty minutes after the application of the time operation start signal S. As a result, the time output signal is provided in the output circuit 5, the output of the frequency divider 34 being applied thereto through the logical circuits AD5, OR8, AD8 and OR9 and the flip-flop 41.

The inventionhas been described with reference to the time which, as shown in FIG. 2, has a plurality of numerical value scales 621 through 624 on the scale board 62.

Figure 4A:
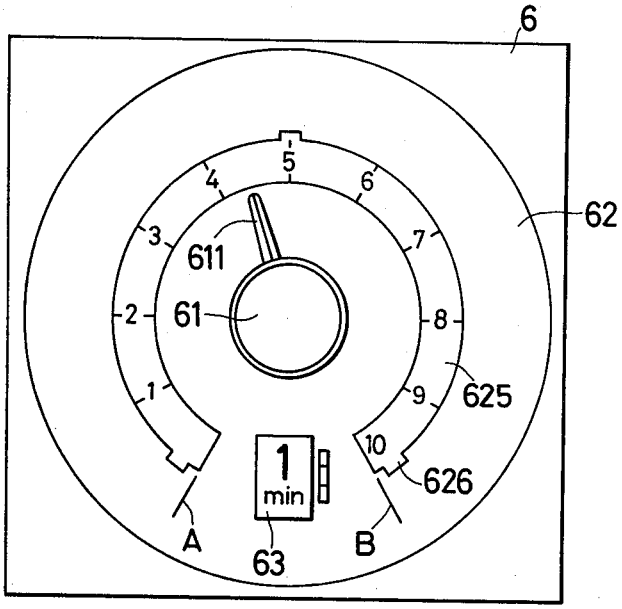
FIG. 4(*a*) is an enlarged view of a time setting section of another embodiment of this invention.
Figure 4B:
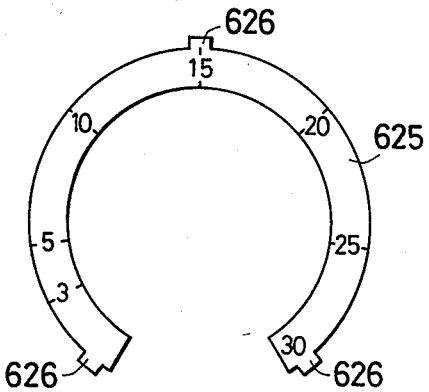

A second embodiment of the invention will now be described with reference to FIG. 4, in which those components which have been previously described with reference to FIG. 2 have therefore been similarly numbered.

In this embodiment, it should be noted that a numerical value scale plate 625 is detachably mounted on the scale board 62. More specifically, if, similarly as in the case of the above described embodiment, the timer has ten time ranges, ten numerical value scale plates 625 graduated according to the respective time ranges are prepared so that they are interchangeably used (mounted thereon) according to a desired time range. Each numerical value scale plate 625 has engaging protrusions 626 to prevent it from accidental removal the scale board 62. In this connection, attention must be paid to the fact that both ends of the numerical value scale plate 625 are aligned with the lines A and B. Since there is only one numerical valuve scale on the scale board 62 in this embodiment, it can easily be read the data on the scale.

In addition, the numerical value scales 621 through 624, FIG. 2 may be modified so that the scales are separate numerical value scale plates which can be detachably mounted on the scale board thereby to use only one of them. Also the arrangement may be a slider with linear scales.

As is apparent from the above description, according to this invention, the use of the digital switch facilitates the use of one timer to set time over a wide time range. Such a timer having various time settings can be manufactured on a single manufacturing line, which leads to a reduction in the manufacturing cost and accordingly to a low price thereof. Furthermore, the use of the timer according to the invention is very convenient as the change of time setting over a wide time range can be simply achieved by merely switching the digital switch.

It is apparent that modifications of this invention are possible without departing from the scope of the invention.

What is claimed is:

1. A multi-range timer comprising: a housing; a dial mounted on said housing; an RC oscillator having a variable resistor whose resistance is varied by rotation of said dial to vary the oscillation frequency of said oscillator; a fixed frequency divider circuit means receiving the output of said oscillator and dividing it by a fixed divisor; variable frequency divider means receiving the output of said fixed divider circuit; and time setting means including digital switch means for switching frequency dividsion ratios in the variable frequency divider means, whereby the time counted by said timer is changed by switching said digital switch means.

2. The timer of claim 1 wherein said time setting means comprises a plurality of color coded numerical display scales mounted on said housing about said dial, said digital switch means having a display means with a surface color coordinated with said scales, said display means of said digital switch indicating the selected time setting range.

3. The timer of claim 2 wherein said numerical value scales are detachable from said housing.

4. The timer of claim 1 further comprising a buffer circuit means for holding the output of said variable frequency divider means.

5. The timer of claim 1 wherein said variable frequency divider means comprises a frequency divider network receiving the output of said fixed frequency divider circuit means, logic means responsive to the output of said frequency divider network, and a decoder means responsive to said digital switch means providing another input to said logic means.

6. The timer of claim 5 wherein said frequency divider network comprises a first series of divider means for dividing the output of said fixed frequency divider circuit means and a second series of divider to subject the output of relevant portions of said logic means to frequency division.

7. The timer of claim 6 wherein said first series of divider means comprises three dividers having divisors of 1/10, 1/30 and 1/60, respectively.

8. The timer of claim 7 wherein said second series of divider means comprises three dividers having divisors of ⅓, 1/5 and 1/6, respectively.

9. The timer of claim 6 wherein said logic means comprises a network of OR gates responsive to said decoder means and a first series of AND gates, said OR gates providing one input to said first series of AND gates and said first series of divider means providing a second input to said first series of AND gates.

10. The timer of claim 9 wherein said logic means further comprises a second series of AND gates, said OR gates providing a first input to said second series of AND gates and said second series of divider means providing a second input to said second series of AND gates.

11. The timer of claim 10 further comprising an output OR gate receiving the outputs of said second series of AND gates.

12. The timer of claim 11 further comprising a flip-flop defining a buffer circuit receiving the output of said output OR gate.

13. The timer of claim 5 or 11, wherein said time setting means further comprises a plurality of color coded numerical display scales mounted on said housing about said dial, said digital switch means having a display means with a surface color coordinated with said scales, said display means of said digital switch means indicating the selected time setting range.

14. The timer of claim 13 wherein said numerical value scales are detachable from said housing.

* * * * *